US009684265B2

(12) United States Patent
Park et al.

(10) Patent No.: US 9,684,265 B2
(45) Date of Patent: Jun. 20, 2017

(54) DEVELOPING DEVICE TO CHARGE AND MIX TONER AND ELECTROPHOTOGRAPHIC IMAGE FORMING APPARATUS INCLUDING THE SAME

(71) Applicant: Samsung Electronics Co., Ltd., Suwon-si, Gyeonggi-do (KR)

(72) Inventors: Jong-hyun Park, Hwaseong-si (KR); Gun Heo, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/065,340

(22) Filed: Mar. 9, 2016

(65) Prior Publication Data

US 2016/0282761 A1 Sep. 29, 2016

(30) Foreign Application Priority Data

Mar. 25, 2015 (KR) ..... 10-2015-0041647

(51) Int. Cl.
*G03G 15/08* (2006.01)

(52) U.S. Cl.
CPC ..... *G03G 15/0891* (2013.01); *G03G 15/0893* (2013.01); *G03G 2215/0827* (2013.01); *G03G 2215/0833* (2013.01); *G03G 2215/0838* (2013.01)

(58) Field of Classification Search
CPC ..... G03G 15/0889; G03G 15/0891
USPC ..... 399/254
See application file for complete search history.

(56) References Cited

U.S. PATENT DOCUMENTS

| | | | | |
|---|---|---|---|---|
| 6,785,481 | B2 | 8/2004 | Bray et al. | |
| 9,348,262 | B1 * | 5/2016 | Suenami | G03G 15/0889 |
| 2010/0034545 | A1 | 2/2010 | Imamura | |
| 2012/0189353 | A1 * | 7/2012 | Mihara | G03G 15/0875 399/258 |
| 2014/0147175 | A1 * | 5/2014 | Makie | G03G 15/0879 399/263 |

* cited by examiner

*Primary Examiner* — Quana M Grainger
(74) *Attorney, Agent, or Firm* — Staas & Halsey LLP

(57) ABSTRACT

Provided is a developing device configured to develop an electrostatic latent image formed on an image bearing member by feeding a toner to the electrostatic latent image. The developing device includes a developing frame configured to form an inner space in which the toner and a carrier are to be mixed, a developing roller including an outer periphery to which the developer attaches where the developing roller feeds the toner included in the developer to the image bearing member. The developing device includes an agitator installed in the inner space and configured to mix and deliver the toner and the carrier in a direction parallel to an axial direction of the developing roller, and a plurality of concave portions arranged on a bottom surface of the developing frame.

20 Claims, 9 Drawing Sheets

DEVELOPING DEVICE TO CHARGE AND MIX TONER AND ELECTROPHOTOGRAPHIC IMAGE FORMING APPARATUS INCLUDING THE SAME

CROSS-REFERENCE TO RELATED APPLICATIONS

This application claims the benefit of Korean Patent Application No. 10-2015-0041647, filed on Mar. 25, 2015, in the Korean Intellectual Property Office, the disclosure of which is incorporated herein in its entirety by reference.

BACKGROUND

1. Field

The present disclosure relates to a developing device using a two-component developer containing a toner and a magnetic carrier, and an image forming apparatus including the same.

2. Description of the Related Art

An electrophotographic image forming apparatus forms an electrostatic latent image on a photosensitive body by irradiating light modulated based on image information onto the photosensitive body, develops the electrostatic latent image into a visible toner image by supplying a toner to the electrostatic latent image, and prints an image on a printing medium by transferring and fixing the toner image to the printing medium.

An imaging forming method, which is performed by the electrophotographic imaging forming apparatus, may be classified as a one-component developing method or a two-component developing method. The one-component developing method uses a one-component developer consisting of a toner. The two-component developing method uses a two-component developer containing a mixture of a toner and a carrier and develops an electrostatic latent image by using the toner alone.

In the two-component developing method, a toner and a carrier are mixed and charged by friction. The charged toner is attached to the carrier by an electrostatic force. The carrier is attached to a developing roller by a magnetic force. The toner is separated from the carrier due to a developing bias voltage applied between the developing roller and the photosensitive body, and is attached to an image region of the photosensitive body, so that an electrostatic latent image is developed into a visible toner image. If the charge amount of toner is insufficient, the toner may be scattered during a developing process. Thus, the toner may contaminate the inside of the image forming apparatus, or the toner may be attached to a non-image region of the photosensitive body, causing background contamination.

SUMMARY

Provided are developing devices capable of sufficiently mixing and agitating a toner and a carrier, and image forming apparatuses including the same.

Additional aspects will be set forth in part in the description which follows and, in part, will be apparent from the description, or may be learned by practice of the presented embodiments.

According to an aspect of an embodiment, there is provided a developing device configured to develop an electrostatic latent image formed on an image bearing member by feeding a toner to the electrostatic latent image. The developing device including a developing frame configured to form an inner space in which a toner and a carrier are mixed, a developing roller including an outer periphery to which the developer attaches where the developing roller is configured to feed the toner included in the developer to the image bearing member, and an agitator installed in the inner space and configured to mix and deliver the toner and the carrier in a direction parallel to an axial direction of the developing roller. The developing device including a plurality of concave portions arranged on a bottom surface of the developing frame.

The agitator may include a rotational shaft provided parallel to an axial direction of the developing roller, and a helical blade provided on an outer periphery of the rotational shaft, the agitator may be further configured to rotate to mix the toner and the carrier while delivering the toner and the carrier, and a plurality of paddles may be provided on the rotational shaft so as to mix the toner and the carrier while rotating in a rotational direction of the rotational shaft.

The plurality of paddles may be arranged in a direction along a length of the rotational shaft.

The plurality of paddles may include first paddles each having a radius of an outermost portion less than a radius of the helical blade.

The plurality of paddles may include second paddles each having a radius of an outermost portion greater than a radius of the helical blade. The second paddles may be provided at positions corresponding to the concave portions.

The plurality of paddles may include first paddles each having a radius of an outermost portion less than a radius of the helical blade, and second paddles each having a radius of an outermost portion greater than the radius of the helical blade. The first paddles and the second paddles may be alternately arranged in a direction along the rotational shaft.

The inner space of the developing frame may include a developing chamber in which the developing roller is installed, and an agitating chamber provided parallel to the developing chamber. The agitating chamber may be configured to have access to the developing chamber at both ends of the developing roller in the axial direction, the agitator may include a first agitator and a second agitator which are respectively provided in the agitating chamber and the developing chamber, and the concave portions provided on the bottom surface of the developing frame may be provided in at least one of the developing chamber and the agitating chamber.

The inner space of the developing frame may include a developing chamber in which the developing roller is installed, and an agitating chamber provided parallel to the developing chamber. The agitating chamber may be configured to have access to the developing chamber at both ends of the developing roller in the axial direction, the agitator may include a first agitator and a second agitator which are respectively provided in the agitating chamber and the developing chamber, and the concave portions provided on the bottom surface of the developing frame may be provided in the agitating chamber.

The first agitator may include a rotational shaft provided parallel to the axial direction of the developing roller, and a helical blade provided on an outer periphery of the rotational shaft, the agitator may be configured to rotate to mix the toner and the carrier while delivering the toner and the carrier, and a plurality of paddles may be arranged on the rotational shaft in a direction along the rotational shaft so as to mix the toner and the carrier while rotating in a rotational direction.

Each of the plurality of paddles may have a radius of an outermost portion greater than a radius of the helical blade, and the plurality of paddles may be provided at positions corresponding to the concave portions.

According to an aspect of another embodiment, there is provided an electrophotographic image forming apparatus configured to use a developer in which a toner and a carrier are mixed, where the electrophotographic image forming apparatus includes the image bearing member on which an electrostatic latent image is to be formed, and a developing device. The developing device includes a developing frame configured to form an inner space in which a toner and a carrier are mixed as a developer, and an agitator installed in the inner space of the developing frame, where the agitator is configured to mix and deliver the toner and the carrier in a direction parallel to an axial direction of a developing roller. The developing frame includes a plurality of concave portions are arranged on a bottom surface of the developing frame and the developing device is configured to develop the electrostatic latent image by feeding the toner to the electrostatic latent image formed on the image bearing member.

DETAILED DESCRIPTION

Figure 1:
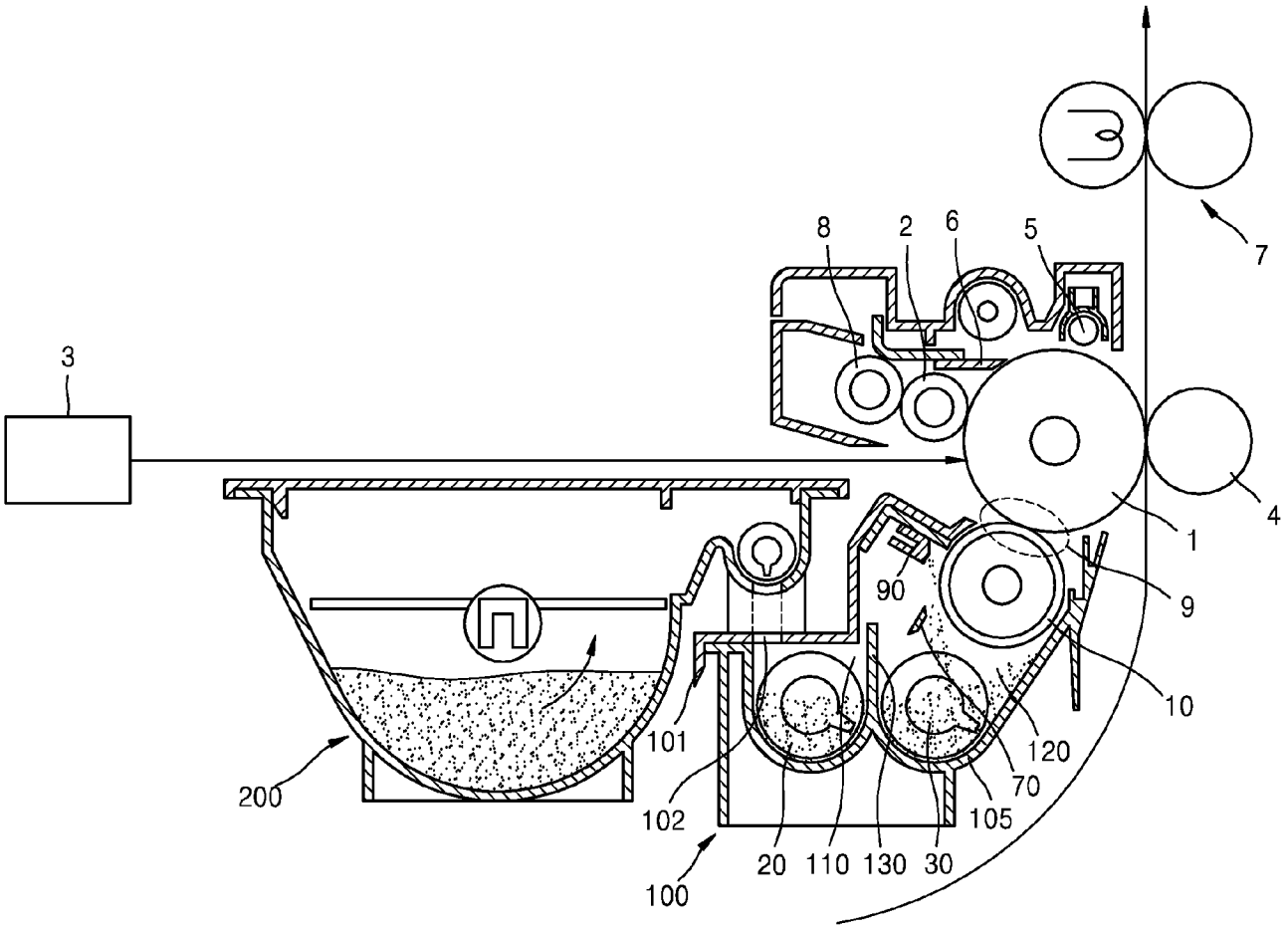
FIG. 1 is a configuration diagram of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects.

Hereinafter, developing devices and electrophotographic image forming apparatuses according to embodiments will be described with reference to the accompanying drawings.

FIG. 1 is a configuration diagram of an electrophotographic image forming apparatus according to an embodiment. The image forming apparatus according to the present embodiment may be a monochromatic image forming apparatus using a two-component developer containing a toner and a magnetic carrier. A color of the toner is, for example, black.

A photosensitive drum 1 is an example of an image bearing member on which an electrostatic latent image is to be formed. In the photosensitive drum 1, a photosensitive layer having photoconductivity is formed on an outer periphery of a cylindrical metal pipe. Instead of the photosensitive drum 1, a photosensitive belt including a photosensitive layer on an outer periphery of a circulating belt may be used.

A charging roller 2 is an example of a charging device configured to charge the surface of the photosensitive drum 1 with uniform charge potential. The charging roller 2 is configured to rotate while being in contact with the photosensitive drum 1. A charging bias voltage is applied to the charging roller 2. As the charging device, a corona charger may be used, which charges the surface of the photosensitive drum 1 by using corona discharge generated by applying a bias voltage between a flat-plate electrode and a wire electrode. A cleaning roller 8 is configured to remove foreign substances from the surface of the charging roller 2.

An exposing device 3 is configured to form an electrostatic latent image by irradiating light corresponding to image information onto the charged surface of the photosensitive drum 1. As the exposing device 3, a laser scanning unit (LSU) may be used, which scans light emitted from a laser diode across the photosensitive drum 1 by deflecting the light in a main scan direction by using a polygon mirror. In addition, as the exposing device 3, a bar-shaped exposing device may used, which includes a plurality of light-emitting devices (e.g., light-emitting diodes (LEDs)) arranged in a main scan direction and configured to be turned on and off according to image information.

A developing device 100 is configured to mix and agitate a toner and a carrier and form a visible toner image on the surface of the photosensitive drum 1 by feeding the toner to the electrostatic latent image formed on the photosensitive drum 1. The developing device 100 may include a developing roller 10 configured to deliver the developer, which includes the toner and the carrier, to a developing region 9 where the developing roller 10 and the photosensitive drum 1 faces each other. The toner is attached to the carrier by an electrostatic force, and the carrier is attached to the surface of the developing roller 10 by a magnetic force. In this way, a developer layer is formed on the surface of the developing roller 10. The developing roller 10 may be disposed to face the photosensitive drum 1. The developing roller 10 may be disposed spaced apart from the photosensitive drum 1 by a developing gap. The developing gap means a gap between an outer peripheral surface of the photosensitive drum 1 and an outer peripheral surface of the developing roller 10 in the developing region 9. The developing gap may be set to about tens of microns to about hundreds of microns. The developing roller 10 is disposed spaced apart from the photosensitive drum 1 by a developing gap. Due to a developing bias voltage applied between the developing roller 10 and the photosensitive drum 1, the toner may move from the developing roller 10 to the photosensitive drum 1 and form a visible toner image on the surface of the photosensitive drum 1. When the toner inside the developing device 100 is consumed, the toner is fed from a toner container 200 to the developing device 100 through a toner feed port 102.

A transfer roller 4 is an example of a transfer device configured to transfer the toner image formed on the photosensitive drum 1 to a printing medium. The transfer roller 4 faces the photosensitive drum 1 to form a transfer nip. A transfer bias voltage is applied to the transfer roller 4. Due to a transfer electric field formed between the photosensitive drum 1 and the transfer roller 4 by the transfer bias voltage, the toner image developed on the surface of the photosensitive drum 1 is transferred on a printing medium P. Instead of the transfer roller 4, a corona transfer device using corona discharge may be used.

After the transfer, the toner remaining on the surface of the photosensitive drum 1 is removed by a cleaning blade (cleaning unit) 6. A charge eliminator 5 may be disposed at an upstream side of the cleaning blade 6 with respect to a rotational direction of the photosensitive drum 1, so as to eliminate electric potential remaining on the photosensitive drum 1. The charge eliminator 5 may, for example, irradiate light onto the surface of the photosensitive drum 1.

The toner image transferred on the printing medium is attached to the printing medium by an electrostatic force. A fixing device 7 is configured to fix the toner image on the printing medium by applying heat and pressure.

An image forming process by the above-mentioned configuration will be described briefly. When the charging bias voltage is applied to the charging roller 2, the surface of the photosensitive drum 1 is charged with uniform potential. The exposing device 3 forms an electrostatic latent image by irradiating light corresponding to image information onto the charged surface of the photosensitive drum 1. When the developing bias voltage is applied to the developing roller 10 to form the developing electric field between the developing roller 10 and the photosensitive drum 1, the toner moves from the developer layer formed on the surface of the developing roller 10 to the surface of the photosensitive drum 1 to thereby develop the electrostatic latent image. In this way, the toner image is formed on the surface of the photosensitive drum 1. A sheet feeding unit (not illustrated) feeds the printing medium to the transfer nip where the photosensitive drum 1 and the transfer roller 4 face each other. Due to the transfer electric field formed by the transfer bias voltage, the toner image is transferred from the surface of the photosensitive drum 1 to the printing medium and is attached to the printing medium P. When the printing medium passes through the fixing device 7, the toner image is fixed on the printing medium by heat and pressure. In this way, image printing is completed. The cleaning blade 6 comes into contact with the surface of the photosensitive drum 1 and removes the toner remaining on the surface of the photosensitive drum 1 after the transfer.

Hereinafter, the configuration of the developing device 100 will be described in detail.

Figure 2:
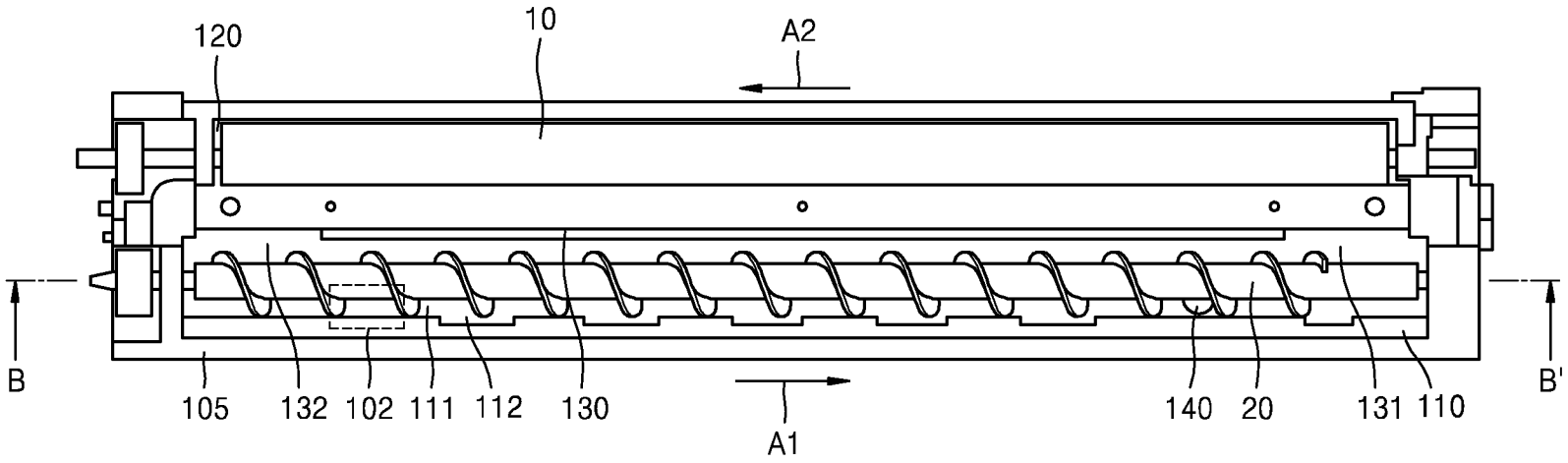
FIG. 2 is a plan view of a developing device according to an embodiment.

FIG. 2 is a plan view of the developing device 100 according to an embodiment. Referring to FIGS. 1 and 2, the toner and the carrier are mixed together while being delivered along the inner space of the developing device 100 in the axial direction of the developing roller 10. During this process, the toner is charged by friction. The developer is attached to the surface of the developing roller 10 and the toner is delivered to the photosensitive drum 1. One or more agitators are installed in the inner space of the developing device 100 and deliver the developer in a direction parallel to the axial direction of the developing roller 10 while mixing and agitating the developer.

The inner space of the developing device 100 may be divided into an agitating chamber 110 and a developing chamber 120 which are disposed parallel to each other. For example, the agitating chamber 110 and the developing chamber 120 may be defined by a developing frame 105. A first agitator 20 is installed in the agitating chamber 110. The developing roller 10 and a second agitator 30 are installed in the developing chamber 120. In FIG. 2, a lid 101 covering the agitating chamber 110 and the developing chamber 120 is not illustrated.

The agitating chamber 110 and the developing chamber 120 are separated from each other by a partition wall 130 extending in the axial direction of the developing roller 10. Openings 131 and 132 are respectively provided on both ends of the partition wall 130 in the length direction, i.e., both ends of the developing roller 10 in the axial direction. The agitating chamber 110 and the developing chamber 120 are connected to each other through the openings 131 and 132. The first and second agitators 20 and 30 may be, for example, augers each having a shaft extending in the axial direction of the developing roller 10, and a helical blade formed on an outer periphery of the shaft. When the first agitator 20 rotates, the developer inside the agitating chamber 110 is delivered in an axial direction (first direction) A1 by the first agitator 20 and is then delivered to the developing chamber 120 through the opening 131 provided in the vicinity of one end of the partition wall 130. The developer inside the developing chamber 120 is delivered in an axial direction (second direction) A2, i.e., in a direction opposite to the direction of delivery by the first agitator 20, by the second agitator 30 and is then delivered to the agitating chamber 110 through the opening 132 provided in the vicinity of the other end of the partition wall 130. In this way, the developer is circulated along the agitating chamber 110 and the developing chamber 120 and is fed to the developing roller 10 disposed in the developing chamber 120 during the circulation process.

As the toner is developed from the developing roller 10 to the photosensitive drum 1, the amount of the toner inside the agitating chamber 110 and the developing chamber 120 is reduced. A toner concentration sensor 140 may be provided in the developing device 100, so as to detect a toner concentration in the developer. The toner concentration sensor 140 may be provided in, for example, the agitating chamber 110. The toner concentration may be expressed by a weight ratio of the toner with respect to a total weight of the developer. The toner concentration sensor 140 may be a magnetic sensor configured to indirectly detect the toner concentration by measuring a strength of a magnetic force generated by the carrier. When the amount of carrier is relatively large and the amount of toner is small in a detection region of the toner concentration sensor 140, the strength of the magnetic field detected by the toner concentration sensor 140 increases. In contrast, when the amount of toner is relatively large in the detection region, the strength of the magnetic field detected by the toner concentration sensor 140 decreases. The toner concentration sensor 140 may detect the toner concentration by using a relationship between the detected strength of the magnetic field and the toner concentration. In another example, the toner concentration sensor 140 may be a capacitive sensor configured to detect the toner concentration by using a difference of permittivity between the carrier and the toner. When the toner concentration detected by the toner concentration sensor 140 is below a reference toner concentration, the toner may be replenished to the developing device 100. The toner may be replenished from the toner container 200 to the agitating chamber 110 through the toner feed port 102. Due to such an operation, the toner concentration inside the developing device 100 may be constantly maintained. The toner container 200 may be integrally formed with the developing device 100. In addition, the toner container 200 may be replaced independently of the developing device 100.

Figure 3:
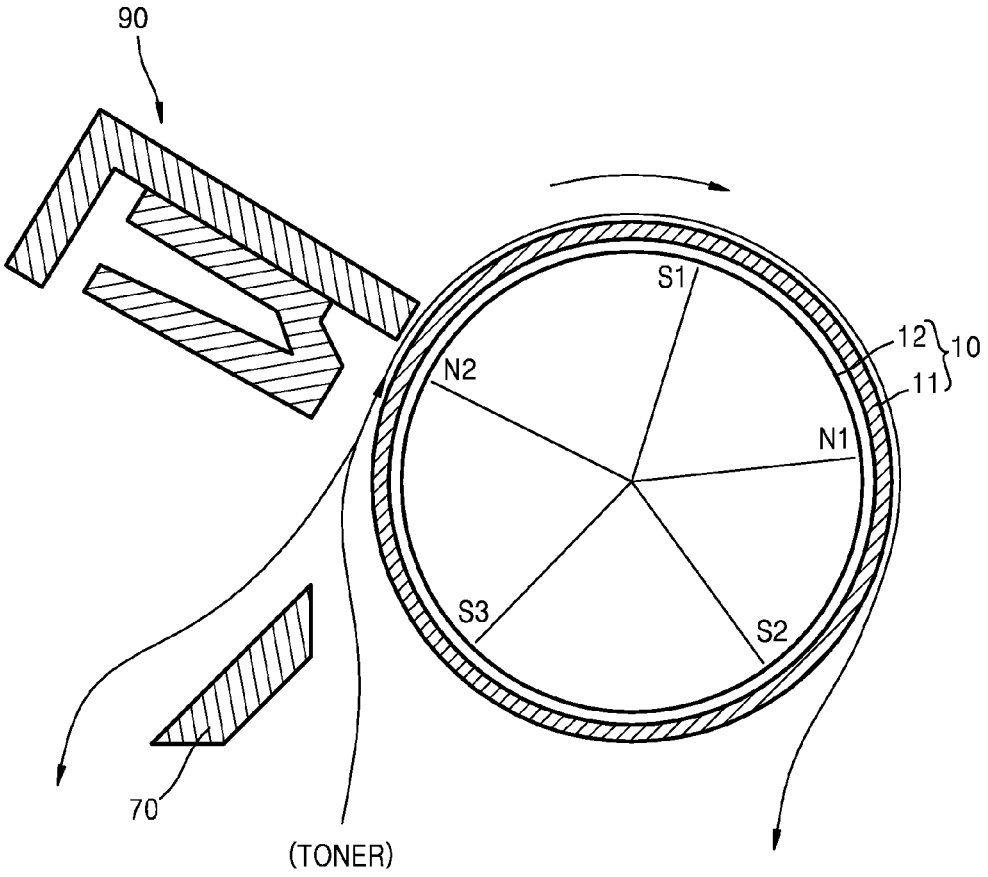
FIG. 3 is a cross-sectional view of a developing roller according to an embodiment.

FIG. 3 is a cross-sectional view of the developing roller 10 according to an embodiment. Referring to FIG. 3, the developing roller 10 may include a rotatable sleeve 11 and a magnet (magnetic pole member) 12 installed inside the sleeve 11. A rotating direction of the sleeve 11 may be opposite to a rotating direction of the photosensitive drum 1. That is, a moving direction of a surface of the sleeve 11 may be the same as a moving direction of a surface of the photosensitive drum 1 in a region where the sleeve 11 and the photosensitive drum 1 face each other. However, the scope of the inventive concept is not limited thereto. The rotating direction of the sleeve 11 may be the same as the rotating direction of the photosensitive drum 1. The magnet 12 may not rotate. The magnet 12 may have a plurality of magnetic poles. The plurality of magnetic poles may include, for example, a main pole S1 that faces the photosensitive drum 1, a carrying pole N1, a separation pole S2, a catch pole S3, and a regulation pole N2 that are sequentially arranged from the main pole S1 in the rotating direction of the sleeve 11.

The carrier in the developer delivered to the developing chamber 120 is attached to the outer periphery of the developing roller 10 by a magnetic force of the catch pole S3, and the toner is attached to the carrier by an electrostatic force. Accordingly, a developer layer including the carrier and the toner is formed on the outer periphery of the developing roller 10.

A regulation member 90 is configured to regulate the developer layer, which is fed to the developing region 9, to a uniform thickness. The regulation member 90 faces the regulation pole N2. As the sleeve 11 rotates, the developer layer, which is formed on the outer periphery of the sleeve 11 due to the magnetic force of the catch pole S3, is delivered to the regulation pole N2. The thickness of the developer layer is regulated by the regulation member 90. The developer, which is blocked by the regulation member 90 and is separated from the developing roller 10, is guided by a guide member 70 and is recovered into the developing chamber 120. As the sleeve 11 is rotated, the developing layer, which is regulated to the uniform thickness, is delivered to the main pole S1 disposed in the developing region 9. In the developing region 9, due to the developing bias voltage applied to the sleeve 11, the toner of the developer layer formed on the surface of the sleeve 11 crosses the developing gap and is attached to the electrostatic latent image formed on the surface of the photosensitive drum 1. After passing the developing region 9, the developer remaining on the outer periphery the sleeve 11 is delivered to the separation pole S2 via the carrying pole N1. In the separation pole S2, the developer is separated from the outer periphery of the sleeve 11 due to a magnetic repulsive force between the separation pole S2 and the catch pole S3 adjacent thereto and falls into the developing chamber 120. Due to such a circulation structure, a new toner is fed to the developing region 9.

The toner, which is fed to the agitating chamber 110 through the toner feed port 102, is mixed and agitated with the developer inside the agitating chamber 110 by the first agitator 20. During this process, the toner is charged by friction with the carrier. A charge amount of toner influences image quality. If the charge amount of toner is insufficient, that is, toner is insufficiently charged, the toner may be attached to the non-image region of the electrostatic latent image when the toner crosses the developing gap and is developed from the developing roller 10 to the photosensitive drum 1, causing a background contamination. In addition, the toner may be scattered into the image forming apparatus, and the inside of the image forming apparatus may be contaminated by the scattered toner. Therefore, there is a need for apparatuses and methods capable of sufficiently charging a toner. Hereinafter, embodiments for sufficiently charging a toner will be described.

Figure 4:
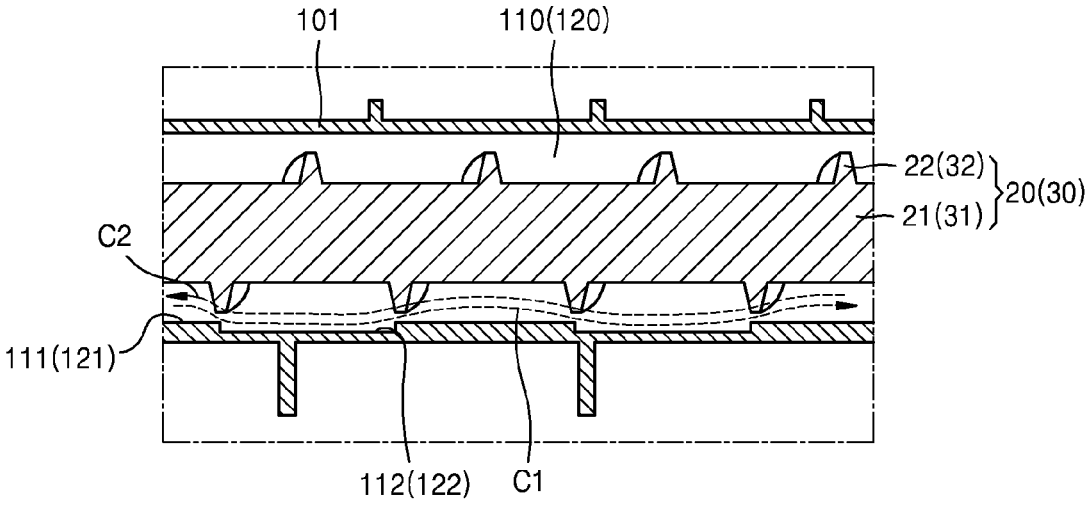
FIG. 4 is a cross-sectional view taken along a line B-B' of FIG. 2.

FIG. 4 is a cross-sectional view taken along a line B-B' of FIG. 2. Referring to FIGS. 2 and 4, a first agitator 20 is installed in the agitating chamber 110. The first agitator 20 delivers a developer in an axial direction. For example, the first agitator 20 may include a rotational shaft 21 extending in the axial direction of a developing roller 10, and a helical blade 22 formed on the outer periphery of the rotational shaft 21. A bottom surface 111 of the agitating chamber 110 may be a semicylindrical surface that is concentric with the rotational shaft 21. A plurality of concave portions 112, which are stepped concavely from the bottom surface 111 of the agitating chamber 110, may be provided on the bottom surface 111 of the agitating chamber 110. That is, the plurality of concave portions 112 are formed to be stepped concavely from the bottom surface of the developing frame 105. The plurality of concave portions 112 are arranged in a direction along the rotational shaft 21. Due to such a configuration, the developer is delivered along the bottom surface 111 and the concave portions 112 of the agitating chamber 110 by the first agitator 20 while its height is changed, as indicated by an arrow C1 of FIG. 4. During this process, a moving speed of the carrier and the toner is reduced and a moving path thereof is increased. In addition, while repeatedly passing through the bottom surface 111 and the concave portions 112 of the agitating chamber 110 which are stepped each other, the toner and the carrier are mixed in a direction along the rotational shaft 21, resulting in an increase in mixing efficiency. Therefore, the mixing and friction time of the toner and the carrier increases, and the friction between the toner and the carrier actively occurs. Hence, the toner may be sufficiently charged.

The above-described configuration may also be applied to the developing chamber 120. Referring to reference numerals given in parentheses in FIG. 4, the second agitator 30 is installed in the developing chamber 120. The second agitator 30 delivers the developer in the axial direction. For example, the second agitator 30 may include a rotational shaft 31 extending in the axial direction of the developing roller 10, and a helical blade 32 formed on the outer periphery of the rotational shaft 31. A bottom surface 121 of the developing chamber 120 may be a semicylindrical surface that is concentric with the rotational shaft 31. A plurality of concave portions 122, which are stepped concavely from the bottom surface 121 of the developing chamber 120, may be provided on the bottom surface 121 of the developing chamber 120, i.e., the bottom surface of the developing frame 105. The plurality of concave portions 122 are arranged in a direction along the rotational shaft 31. Due to such a configuration, the developer is delivered along the bottom surface 121 and the concave portions 122 of the developing chamber 120 by the second agitator 30 while its height is changed, as indicated by an arrow C2 of FIG. 4. During this process, a moving speed of the carrier and the toner is reduced and a moving path thereof is increased. While repeatedly passing through the bottom surface 121 and the concave portions 122 of the developing chamber 120 which are stepped each other, the toner and the carrier are mixed in a direction along the rotational shaft 31, resulting in an increase in mixing efficiency. Therefore, the mixing and friction time of the toner and the carrier increases, and the friction between the toner and the carrier actively occurs. Hence, the toner may be sufficiently charged.

The toner and the carrier are mixed and agitated while being delivered in the axial direction by the first and second agitators 20 and 30. The mixing and agitation efficiency of the toner and the carrier may be improved by mixing the toner and the carrier in a rotating direction of the first and second agitators 20 and 30.

Figure 5:
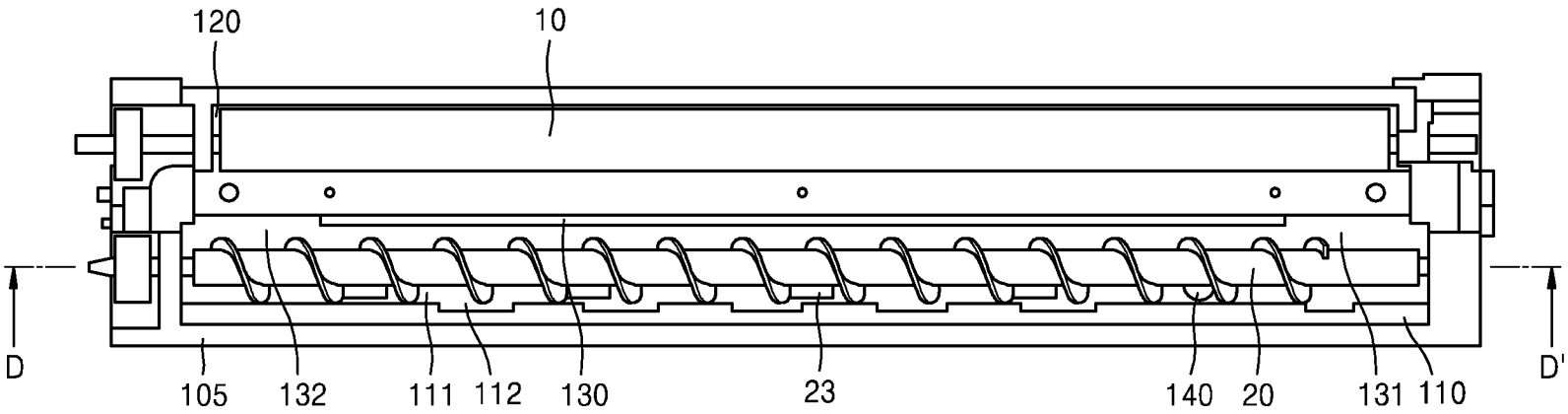
FIG. 5 is a plan view of a developing device according to another embodiment.
Figure 6:
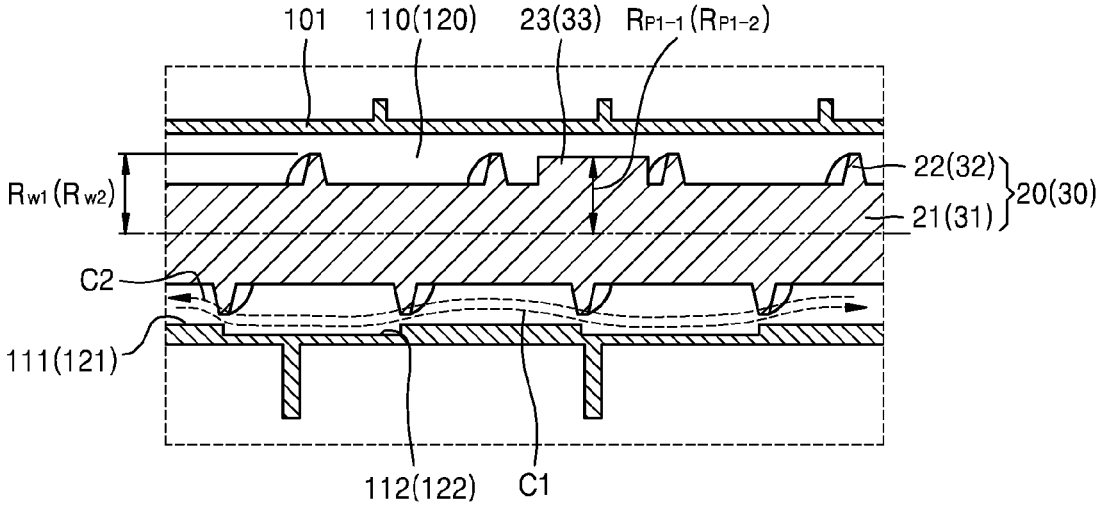
FIG. 6 is a cross-sectional view taken along a line D-D' of FIG. 5.

FIG. 5 is a plan view of a developing device 100 according to another embodiment, and FIG. 6 is a cross-sectional view taken along a line D-D' of FIG. 5. The embodiment illustrated in FIGS. 5 and 6 differs from the embodiment illustrated in FIGS. 2 and 4 in that a paddle 23 is provided on a rotational shaft 21 of a first agitator 20 so as to stir a toner and a carrier in a radial direction. The paddle 23 extends from the rotational shaft 21 in the radial direction and has a length in an axial direction. A plurality of paddles 23 may be arranged in the axial direction. An outermost radius $R_{P1-1}$ of the paddle 23 may be less than or equal to a radius $R_{w1}$ of a helical blade 22. According to such a configuration, since the toner and the carrier are stirred in a rotating direction, it is possible to effectively mix and charge the toner and the carrier by friction.

The above-described configuration may also be applied to a developing chamber 120. Referring to reference numerals given in parentheses in FIG. 6, a paddle 33 is provided on a rotational shaft 31 of a second agitator 30 so as to stir the toner and the carrier in the radial direction. The paddle 33 extends from the rotational shaft 31 in the radial direction and has a length in an axial direction. A plurality of paddles 33 may be arranged in the axial direction. An outermost radius $R_{P1-2}$ of the paddle 33 may be less than or equal to a radius $R_{w2}$ of a helical blade 32. According to such a configuration, since the toner and the carrier are stirred in a rotating direction, it is possible to effectively mix and friction-charge the toner and the carrier.

Figure 7:
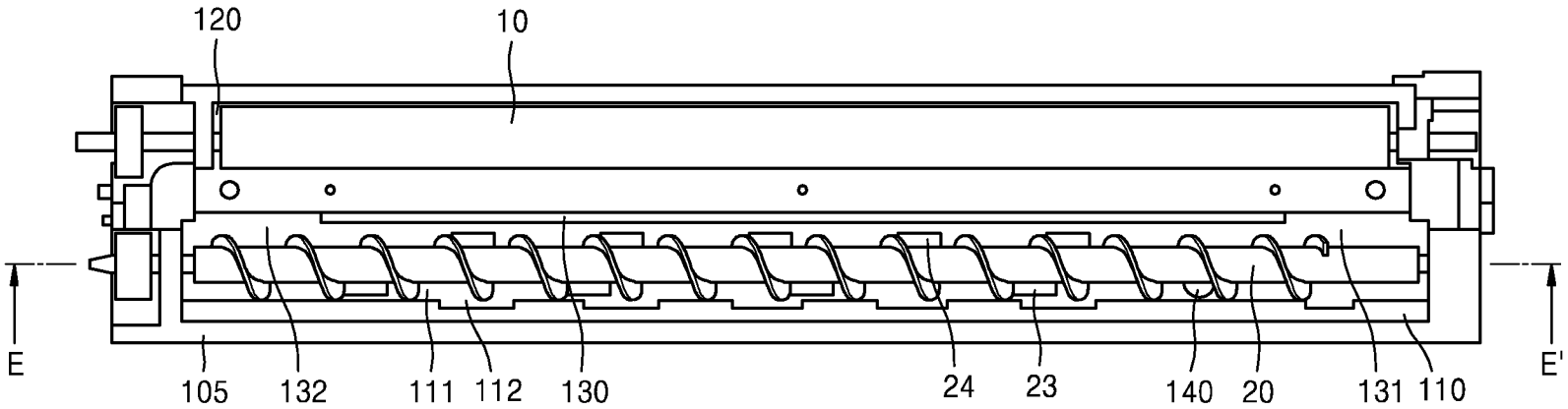
FIG. 7 is a plan view of a developing device according to another embodiment.
Figure 8:
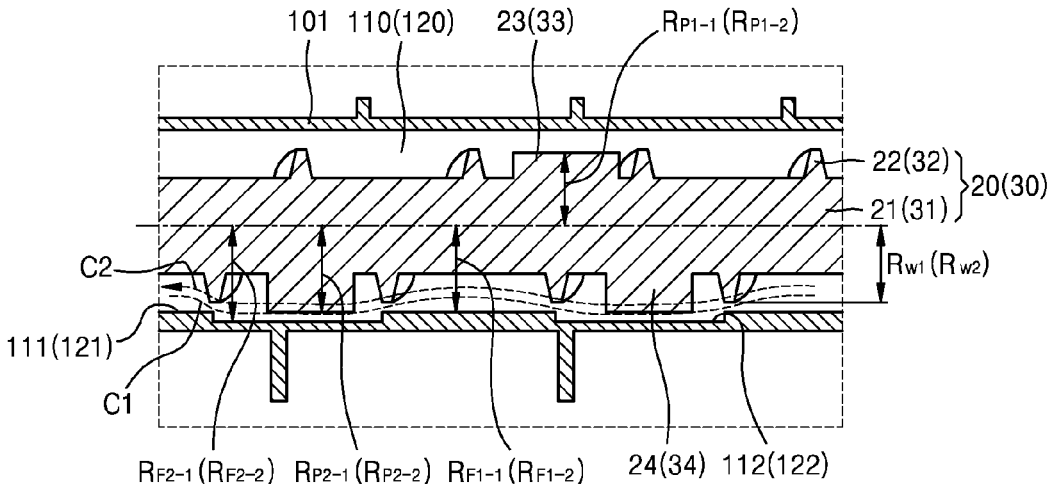
FIG. 8 is a cross-sectional view taken along a line E-E' of FIG. 7.

FIG. 7 is a plan view of a developing device 100 according to another embodiment, and FIG. 8 is a cross-sectional view taken along a line E-E' of FIG. 7. The embodiment illustrated in FIGS. 7 and 8 differs from the embodiment illustrated in FIGS. 5 and 6 in that a paddle 24 more protruding in a radial direction than a helical blade 22 is provided on a rotational shaft 21 of a first agitator 20 so as to stir a toner and a carrier in a radial direction. The paddle 24 extends from the rotational shaft 21 in the radial direction and has a length in an axial direction. A plurality of paddles 24 may be arranged in the axial direction. The paddles 24 are disposed at positions corresponding to concave portions 112. The paddles (first paddles) 23 and the paddles (second paddles) 24 may be alternately disposed in a direction along the rotational shaft 21. An outermost radius $R_{P2-1}$ of the paddle 24 is greater than a radius Rw1 of the helical blade 22. According to such a configuration, since the toner and the carrier in the concave portion 112 are stirred in a rotating direction, it is possible to effectively mix and friction-charge the toner and the carrier.

As a difference between the outermost radius $R_{P2-1}$ of the paddle 24 and the radius $R_{w1}$ of the helical blade 22 increases, the mixing efficiency in the rotating direction is further improved. For example, when the difference between the outermost radius $R_{P2-1}$ of the paddle 24 and the radius $R_{w1}$ of the helical blade 22 is less than about 2 mm, the mixing efficiency may be improved without increasing the sizes of the first agitator 20 and the developing device 100. However, the scope of the inventive concept is not limited thereto. The difference between the outermost radius $R_{P2-1}$ of the paddle 24 and the radius Rw1 of the helical blade 22 may be set to be about 2 mm or more, taking into consideration the size and the mixing performance of the first agitator 20 and the developing device 100.

A difference between the radius $R_{w1}$ of the helical blade 22 and a radius $R_{F1-1}$ of the bottom surface 111 based on the rotational shaft 21 may be about 1 mm to about 2 mm, but this is merely an example. The scope of the inventive concept is not limited to the numerical range. A difference between the outermost radius $R_{P2-1}$ of the paddle 24 and a radius $R_{F2-1}$ of the concave portion 112 based on the rotational shaft 21 may be equal to a difference between the radius $R_{w1}$ of the helical blade 22 and the radius $R_{F1-1}$ of the bottom surface 111 based on the rotational shaft 21, but the inventive concept is not limited thereto. A difference between the outermost radius $R_{P2-1}$ of the paddle 24 and the radius $R_{F2-1}$ of the concave portion 112 based on the rotational shaft 21 may be about 1 mm to about 2 mm, but this is merely an example. The scope of the inventive concept is not limited to the numerical range. The outermost radius $R_{P2-1}$ of the paddle 24 may be less than or greater than the radius $R_{F1-1}$ of the bottom surface 111 based on the rotational shaft 21.

Although FIGS. 7 and 8 illustrate the embodiment in which both the paddles 23 and 24 are applied, the paddles 23 may be omitted and only the paddles 24 may be applied.

The above-described configuration may also be applied to a developing chamber 120. Referring to reference numerals given in parentheses in FIG. 8, a paddle 34 more protruding in a radial direction than a helical blade 32 is provided on a rotational shaft 31 of a second agitator 30 so as to stir a toner and a carrier in the radial direction. The paddle 34 extends from the rotational shaft 31 in the radial direction and has a length in an axial direction. A plurality of paddles 34 may be arranged in the axial direction. The paddles 34 are disposed at positions corresponding to concave portions 122. The paddles (first paddles) 33 and the paddles (second paddles) 34 may be alternately disposed in a direction along the rotational shaft 31. An outermost radius $R_{P2-2}$ of the paddle 34 is greater than a radius $R_{w2}$ of the helical blade 32. According to such a configuration, since the toner and the carrier in the concave portion 122 are stirred in a rotating direction, it is possible to effectively mix and charge the toner and the carrier by friction.

As a difference between the outermost radius $R_{P2-2}$ of the paddle 34 and the radius $R_{w2}$ of the helical blade 32 increases, the mixing efficiency in the rotating direction is further improved. For example, when the difference between the outermost radius $R_{P2-2}$ of the paddle 34 and the radius $R_{w2}$ of the helical blade 32 is less than about 2 mm, the mixing efficiency may be improved without increasing the sizes of the second agitator 30 and the developing device 100. However, the scope of the inventive concept is not limited thereto. The difference between the outermost radius $R_{P2-2}$ of the paddle 34 and the radius $R_{w2}$ of the helical blade 32 may be set to be about 2 mm or more, taking into consideration the size and the mixing performance of the first agitator 20 and the developing device 100.

A difference between the radius $R_{w2}$ of the helical blade 32 and the radius $R_{F1-2}$ of the bottom surface 121 based on the rotational shaft 31 may be about 1 mm to about 2 mm, but this is merely an example. The scope of the inventive concept is not limited to the numerical range. A difference between the outermost radius $R_{P2-2}$ of the paddle 34 and a radius $R_{F2-2}$ of the concave portion 122 based on the rotational shaft 31 may be equal to a difference between the radius $R_{w2}$ of the helical blade 32 and the radius $R_{F1-2}$ of the bottom surface 121 based on the rotational shaft 31, but the inventive concept is not limited thereto. A difference between the outermost radius $R_{P2-2}$ of the paddle 34 and the radius $R_{F2-2}$ of the concave portion 122 based on the rotational shaft 31 may be about 1 mm to about 2 mm, but this is merely an example. The scope of the inventive concept is not limited to the numerical range. The outermost radius $R_{P2-2}$ of the paddle 34 may be less than or greater than the radius $R_{F1-2}$ of the bottom surface 121 based on the rotational shaft 31.

Figure 9:
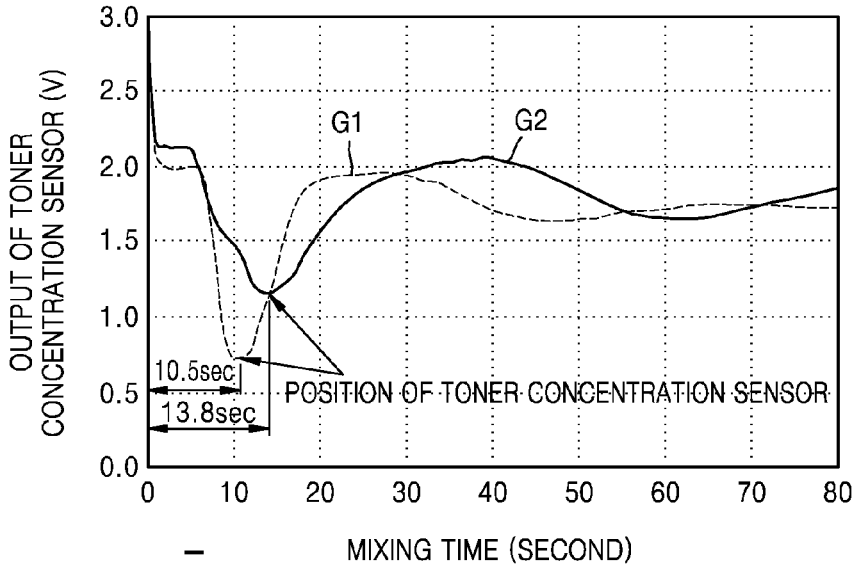
FIG. 9 is a graph showing a test result of a mixing and charging effect in the embodiment of FIG. 7.

FIG. 9 is a graph showing a test result of a mixing and charging effect in the embodiment of FIG. 7. In FIG. 9, a horizontal axis represents the mixing time and a vertical axis represents the output voltage of the toner concentration sensor 140. As the output voltage of the toner concentration sensor 140 becomes lower, the toner concentration is reduced. "0" in the horizontal axis represents a time point when the new toner is fed to the toner feed port 102. G1 represents a case where the concave portions 112 and the paddles 23 and 24 are not applied, and G2 represents a case where the concave portions 112 and the paddles 23 and 24 are applied.

Referring to G1 of FIG. 9, the new toner, which is fed to the agitating chamber 110 through the toner feed port 102, is mixed with the carrier by the first agitator 20 and, after about 10.5 seconds, arrives at a position where the toner concentration sensor 140 is installed. At this time, a toner concentration value is rapidly reduced. In this state, if the toner is fed to the developing chamber 120 through the opening 131, an absolute amount of toner and a chartge amount of toner are insufficient, causing a background contamination.

Referring to G2 of FIG. 9, the new toner, which is fed to the agitating chamber 110 through the toner feed port 102, is mixed with the carrier by the first agitator 20 and, after about 13.8 seconds, arrives at a position where the toner concentration sensor 140 is installed. Therefore, as compared with G1, the mixing and agitating time may be increased by about 3.3 seconds and the toner concentration may be less reduced, because the carrier and the toner are effectively mixed for the time additionally ensured by the concave portions 112 and the paddles 23 and 24. Since the time when the developer circulates the agitating chamber 110 and the developing chamber 120 once is increased from about 36.5 seconds to about 47.8 seconds, it is possible to sufficiently ensure the mixing and agitating time. In addition, since a change in the toner concentration according to the passage of time is small, it is possible to implement a stable image quality.

As described above, by employing the concave portions 112 and the paddles 23 and 24, the toner and the carrier may be effectively mixed and the toner may be sufficiently charged. Therefore, it is possible to reduce a risk of image quality degradation caused by the reduction in the charge amount of toner. Furthermore, even when the performance of the developer is degraded due to a long-term use thereof, the toner may be sufficiently charged. Therefore, it is possible to maintain a stable image quality during the life period of the developing device 100.

FIG. 9 illustrates a case where the concave portions 112 and the paddles 23 and 24 are applied to the agitating chamber 110 and the first agitator 20, but from this result, similar effects may be obtained in a case where only the concave portions 112 are applied, a case where the concave portions 112 and the paddles 23 are applied, a case where the concave portions 112 and the paddles 24 are applied, and a case where these configurations are applied to the developing chamber 120 and the second agitator 30.

Figure 10:
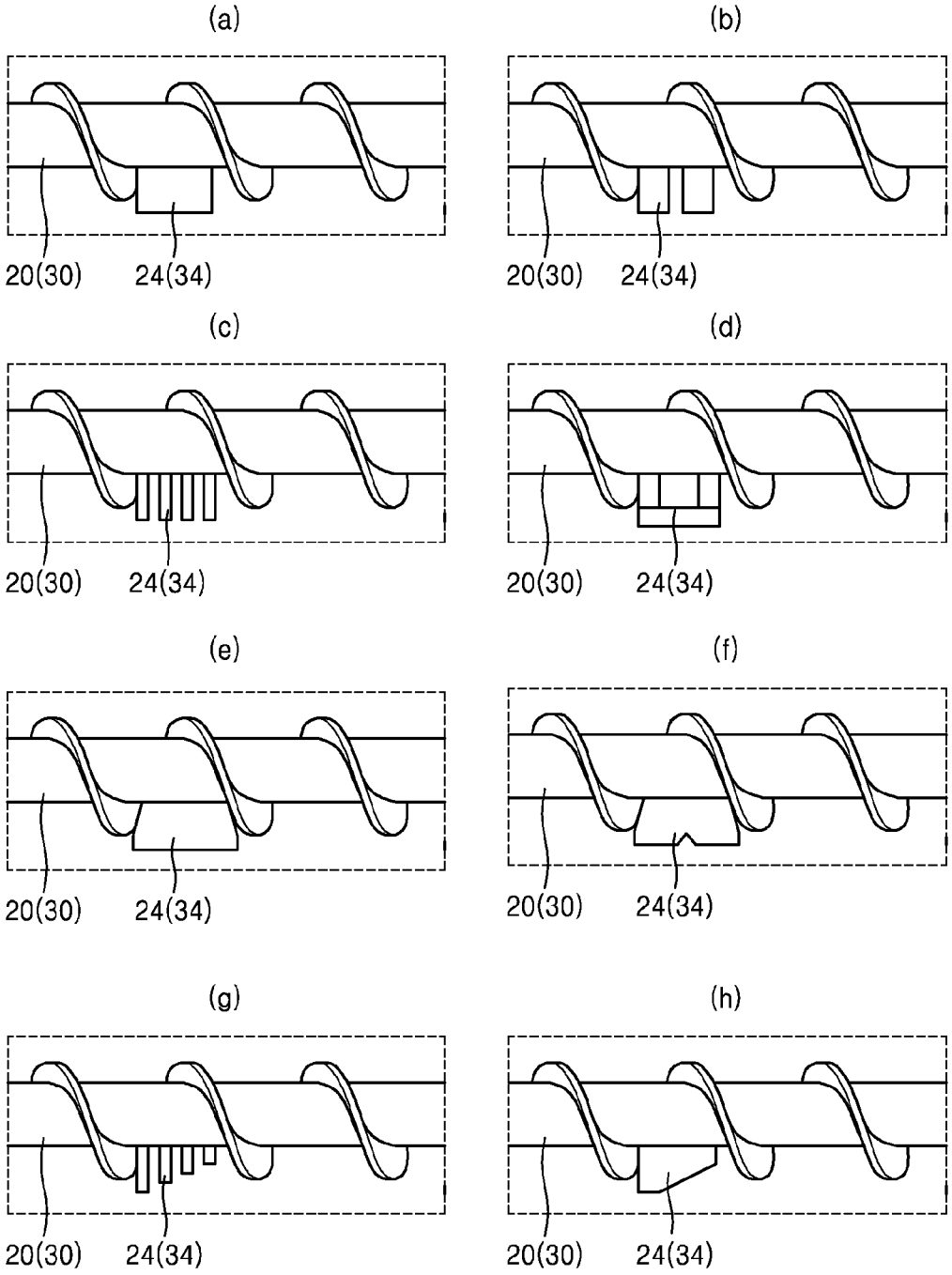
FIG. 10 is a diagram illustrating various examples of paddles.

FIG. 10 illustrates various examples of the paddles 24. Although examples of the paddles 24 and 34 are illustrated in FIG. 10, the examples illustrated in FIG. 10 may be referenced as the form of the paddles 23 and 33. The number, positions, sizes, and shapes of the concave portions 112 and 122, the paddles 23 and 33, and the paddles 24 and 34 may be appropriately selected so as to obtain a desired toner concentration and a desired charge amount of toner.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A developing device configured to develop an electrostatic latent image formed on an image bearing member by feeding a toner to the electrostatic latent image, the developing device comprising:

a developing frame configured to form an inner space in which a toner and a carrier are mixed as a developer;

a developing roller including an outer periphery to which the developer attaches, the developing roller being configured to feed the toner included in the developer to the image bearing member; and an agitator installed in the inner space of the developing frame, the agitator being configured to mix and deliver the toner and the carrier in a direction parallel to an axial direction of the developing roller, wherein a plurality of portions stepped inward from a bottom surface of the developing frame and arranged to have respective bottom surfaces parallel to the axial direction of the developing roller along the bottom surface are provided.

2. The developing device of claim 1, wherein the agitator comprises a rotational shaft provided parallel to the axial direction of the developing roller, and a helical blade provided on an outer periphery of the rotational shaft, the agitator is further configured to rotate to mix the toner and the carrier while delivering the toner and the carrier, and a plurality of paddles are arranged on the rotational shaft in the axial direction so as to mix the toner and the carrier in a rotational direction of the agitator.

3. The developing device of claim 2, wherein the plurality of paddles are arranged in a direction along a length of the rotational shaft.

4. The developing device of claim 2, wherein the plurality of paddles comprise first paddles each having a radius of an outermost portion less than a radius of the helical blade.

5. The developing device of claim 2, wherein the plurality of paddles comprise second paddles each having a radius of an outermost portion greater than a radius of the helical blade.

6. The developing device of claim 5, wherein the second paddles are provided at positions corresponding to the plurality of portions.

7. The developing device of claim 2, wherein the plurality of paddles comprise first paddles each having a radius of an outermost portion less than a radius of the helical blade, and second paddles each having a radius of an outermost portion greater than the radius of the helical blade.

8. The developing device of claim 7, wherein the first paddles and the second paddles are alternately arranged in a direction along the rotational shaft.

9. The developing device of claim 1, wherein the inner space of the developing frame comprises a developing chamber in which the developing roller is installed, and an agitating chamber provided parallel to the developing chamber, the agitating chamber is configured to have access to the developing chamber at both ends of the developing roller in the axial direction, the agitator comprises a first agitator and a second agitator which are respectively provided in the agitating chamber and the developing chamber, and the plurality of portions provided on the bottom surface of the developing frame are provided in at least one of the developing chamber and the agitating chamber.

10. The developing device of claim 1, wherein the inner space of the developing frame comprises a developing chamber in which the developing roller is installed, and an agitating chamber provided parallel to the developing chamber, the agitating chamber is configured to have access to the developing chamber at both ends of the developing roller in the axial direction, the agitator comprises a first agitator and a second agitator which are respectively provided in the agitating chamber and the developing chamber, and the plurality of portions provided on the bottom surface of the developing frame are provided in the agitating chamber.

11. The developing device of claim 10, wherein the first agitator comprises a rotational shaft provided parallel to the axial direction of the developing roller, and a helical blade provided on an outer periphery of the rotational shaft, the agitator is further configured to rotate to mix the toner and the carrier while delivering the toner and the carrier, and a plurality of paddles are arranged on the rotational shaft in a direction along the rotational shaft so as to mix the toner and the carrier while rotating in a rotational direction.

12. The developing device of claim 11, wherein each of the plurality of paddles has a radius of an outermost portion greater than a radius of the helical blade, and the plurality of paddles are provided at positions corresponding to the plurality of portions.

13. An electrophotographic image forming apparatus, comprising:

an image bearing member on which an electrostatic latent image is to be formed;

a developing device, the developing including:

a developing frame configured to form an inner space in which a toner and a carrier are mixed as a developer; and an agitator installed in the inner space of the developing frame, the agitator being configured to mix and deliver the toner and the carrier in a direction parallel to an axial direction of a developing roller, wherein a plurality of portions stepped inward from a bottom surface of the developing frame and arranged to have respective bottom surfaces parallel to the axial direction of the developing roller along the bottom surface, wherein the developing device is configured to develop the electrostatic latent image by feeding the toner to the electrostatic latent image formed on the image bearing member.

14. The electrophotographic image forming apparatus of claim 13, wherein the agitator comprises a rotational shaft provided parallel to the axial direction of the developing roller, and a helical blade provided on an outer periphery of the rotational shaft, the agitator is configured to rotate to mix the toner and the carrier while delivering the toner and the carrier, and a plurality of paddles are arranged on the rotational shaft in the axial direction so as to mix the toner and the carrier in a rotational direction of the agitator.

15. The electrophotographic image forming apparatus of claim 14, wherein the plurality of paddles comprise first paddles each having a radius of an outermost portion less than a radius of the helical blade, and second paddles each having a radius of an outermost portion greater than the radius of the helical blade.

16. The electrophotographic image forming apparatus of claim 15, wherein the first paddles and the second paddles are alternately arranged in a direction along the rotational shaft.

17. The electrophotographic image forming apparatus of claim 16, wherein the second paddles are provided at positions corresponding to the plurality of portions.

18. The electrophotographic image forming apparatus of claim 13, wherein the inner space of the developing frame comprises a developing chamber in which the developing roller is installed, and an agitating chamber provided parallel to the developing chamber, the agitating chamber is configured to have access to the developing chamber at both ends of the developing roller in the axial direction, the agitator comprises a first agitator and a second agitator which are respectively provided in the agitating chamber and the developing chamber, and the plurality of portions are provided on the bottom surface of the developing frame are provided in the agitating chamber.

19. The electrophotographic image forming apparatus of claim 18, wherein the first agitator comprises a rotational shaft provided parallel to the axial direction of the developing roller, and a helical blade provided on an outer periphery of the rotational shaft, the agitator is further configured to rotate to mix the toner and the carrier while delivering the toner and the carrier, and a plurality of paddles are arranged on the rotational shaft in a direction along the rotational shaft so as to mix the toner and the carrier while rotating in a rotational direction.

20. The electrophotographic image forming apparatus of claim 19, wherein each of the plurality of paddles has a radius of an outermost portion greater than a radius of the helical blade, and the plurality of paddles are provided at positions corresponding to the plurality of portions.

* * * * *